United States Patent [19]

Gormley

[11] 4,079,935

[45] Mar. 21, 1978

[54] SPORTS EQUIPMENT

[75] Inventor: Ian G. Gormley, Durban, South Africa

[73] Assignee: Zimm-Zamm Aktiengesellschaft, Zurich, Switzerland

[21] Appl. No.: 670,168

[22] Filed: Mar. 25, 1976

Related U.S. Application Data

[63] Continuation of Ser. No. 522,844, Nov. 11, 1974, abandoned.

[30] Foreign Application Priority Data

| | | |
|---|---|---|
| Nov. 9, 1973 | South Africa | 73/8621 |
| Nov. 9, 1973 | South Africa | 73/8622 |
| Apr. 16, 1974 | South Africa | 74/2386 |

[51] Int. Cl.[2] ..... A63B 49/00

[52] U.S. Cl. ..... 273/67 R

[58] Field of Search ..... 273/26 B, 29 A, 67 R, 273/67 A, 67 B, 72 R, 73 R, 73 C, 73 D, 76, 96 R, 96 D, 97 R, 98, 162 R, 162 F, 164, 183 R, 183 D, 186 R, 186 A, 186 C, 186 D, 193 R, 194 R, 194 A; D34/5 S; 46/175, 177

[56] References Cited

U.S. PATENT DOCUMENTS

| | | | |
|---|---|---|---|
| D. 150,805 | 8/1948 | Pauly | 273/76 X |
| D. 191,405 | 9/1961 | Wagner | 273/76 X |
| D. 192,740 | 5/1962 | Ziabicki | 273/76 X |
| D. 226,206 | 1/1973 | Rankin et al. | 273/76 X |
| D. 232,450 | 8/1974 | Chreist et al. | 273/76 X |
| D. 233,355 | 10/1974 | Foley | 273/76 X |
| 1,531,778 | 3/1925 | Gallaudet | 273/73 D |
| 1,682,199 | 8/1928 | Smilie | 273/73 D |
| 2,660,436 | 11/1953 | Grossman | 273/186 D |
| 2,969,984 | 1/1961 | Presnick | 273/73 R |
| 3,169,019 | 2/1965 | Genjack | 273/67 R X |
| 3,820,785 | 6/1974 | Occhipinti et al. | 273/73 R X |

FOREIGN PATENT DOCUMENTS

| | | | |
|---|---|---|---|
| 1,133,204 | 11/1956 | France | 273/76 |
| 1,503,812 | 10/1967 | France | 273/73 C |
| 1,573,987 | 6/1969 | France | 273/73 R |
| 1,398,833 | 4/1965 | France | 273/73 D |
| 1,051,701 | 2/1959 | Germany | 273/73 C |
| 1,089,675 | 9/1960 | Germany | 273/73 C |
| 5,457 of | 1884 | United Kingdom | 273/73 D |
| 3,126 of | 1885 | United Kingdom | 273/73 R |
| 891,047 | 3/1962 | United Kingdom | 273/96 R |

*Primary Examiner*—Richard J. Apley
*Attorney, Agent, or Firm*—Young & Thompson

[57] ABSTRACT

A sports implement comprising head and handle, the head including an integral lacunar structure with a desired striking zone thereof indicated by means chosen from the group comprising a prominent visual indicator whereby the zone is demarcated for visual identification by the player, an impact sensation indicator comprising a material increase in mass of the zone having regard to the total mass of the implement, and an aural indicator comprising means to emit a distinctive sound when the zone is struck.

5 Claims, 5 Drawing Figures

18
22
24
5
5
4
20
14
12
10
14
10
14
10
14
10
18
20
22
4
24
18
14
4

SPORTS EQUIPMENT

This is a continuation of application Ser. No. 522,844, filed Nov. 11, 1974, and now abandoned.

The invention relates to a sports implement comprising a handle, head and integral lattice or lacunar striking area. As with conventional tennis, squash, badminton and the like rackets, the lattice structure includes a zone which imparts the optimum impetus to the object struck. This zone is called "sweet spot" of the implement.

According to the present invention a sports implement comprises head and handle, the head including an integral lacunar striking area with a desired striking zone thereof indicated by means chosen from the group comprising a prominent visual indicator whereby the zone is clearly demarcated for visual identification by the player, an impact sensation indicator comprising a material increase in mass of the zone having regard to the total mass of the implement, and an aural indicator comprising means to emit a distinctive sound when the zone is struck.

The invention is discussed further with reference to the accompanying drawings in which.

Figures 1, 2, 3, 4, 5:
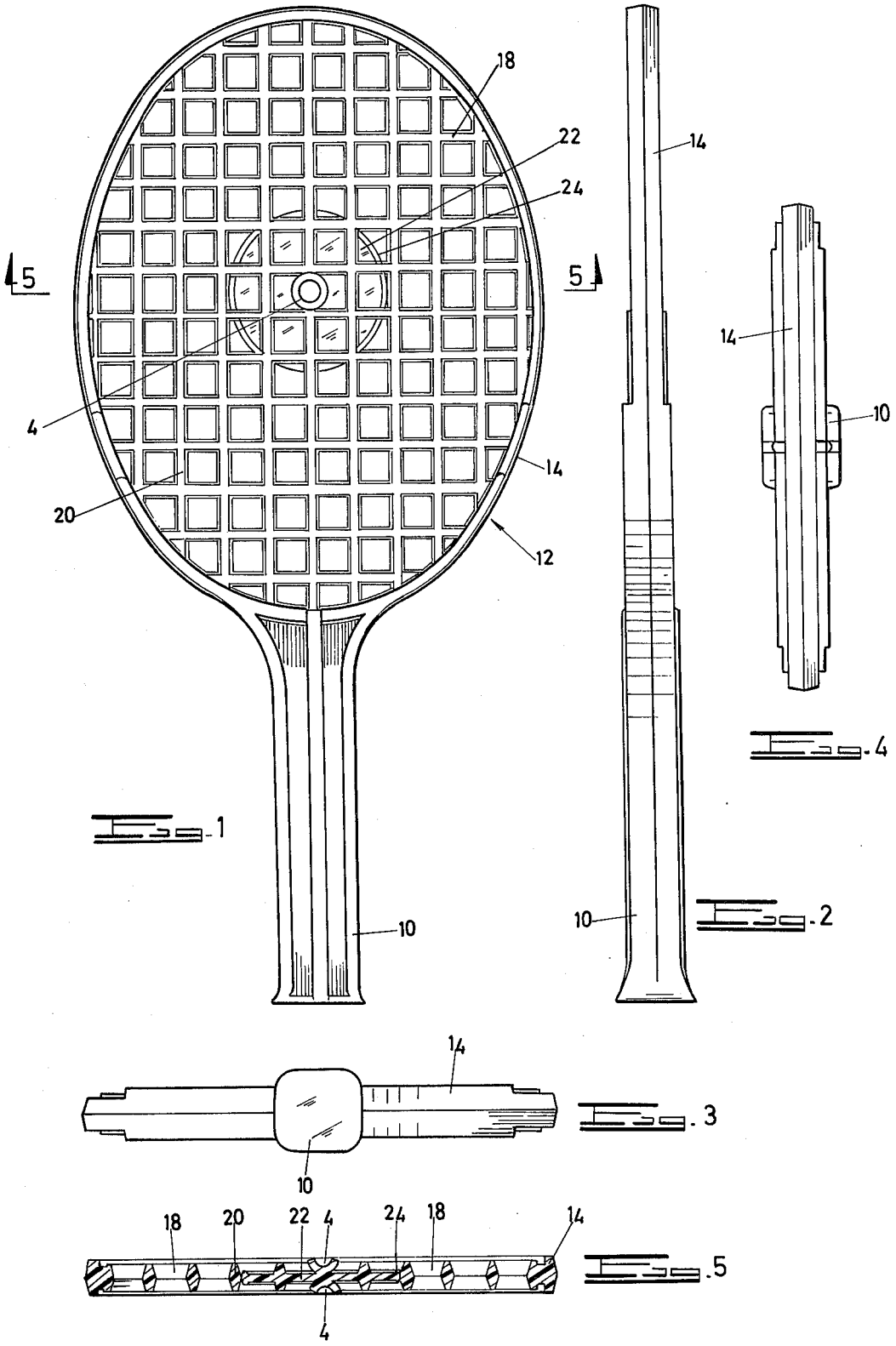
FIG. 1 is a plan view of a racquet according to the invention.
FIG. 2 is a side view of the same racquet.
FIG. 3 is an end view of the same racquet.
FIG. 4 is a view from the opposite end of the same racquet.
FIG. 5 is a view on the line V—V in FIG. 1.

Referring to the drawings, there is illustrated a racquet 2, of the type used for the game ZIMM-ZAMM (trade mark). The racquet 2 is injection-moulded as an integral structure from a suitable plastics material such as polypropylene. It comprises a handle 10 and a head 12. The head 12 in turn comprises a frame 14 integral with a lattice structure 16 contained in the frame. The lattice structure 16 is made up of filaments 18, 20 that extend at right angles to each other and are integral with each other at their intersections. As seen in FIG. 5, the filaments are substantially lozenge-shaped in cross-section.

A substantially central zone of the head 12 of the racquet 2 is occupied by a solid piece 22. The zone is chosen to coincide with the so-called sweet spot of the head 12. The solid piece 22 is in the form of a substantially flat disc, and is integral with, and fills the interstices between, some of the filaments 18 and 20, resulting in an integral webbed structure. The disc 22 is surrounded on its periphery by a thickened annulus 24. The disc 22 may have a mass sufficient effectively to increase the weight of the lattice structure 16 at the sweet spot. The additional weight serves to improve the "feel" of the sweet spot.

Furthermore, there is provided a cup formation 4 on each side of the disc 22. As a result, when a ball collides with the disc 22, a distinctive sound is emitted. Accordingly, a player may hear if he is hitting the ball correctly.

In use, a player uses the disc 22 as a target with which a ball he is striking must connect for optimum results.

Another embodiment of the invention, not illustrated, may take the form of a bat or racquet in which the head is formed by a lattice structure in the form of a board of wood or the like pierced by a series of holes located at intervals from each other. The holes are so dispersed that at least one zone, preferably that of the sweet spot at the centre, has fewer holes per unit than the surrounding zone. The additional board in this area thus serves materially to weight the sweet spot. The sweet spot zone in this embodiment may also include a cup adapted to emit a distinctive sound when struck.

The invention has been discussed above with reference to racquets, but it will be apparent that the principles involved may apply equally to other sports implements used to strike objects to impart motion to them. For example the sweet spots of the striking regions of implements such as golf clubs, baseball and cricket bats, hockey sticks, to name a few, may be visually indicated and if desired weighted. They may also or alternatively be adapted to emit distinctive sounds on collision of the sweet spot with a ball, puck, or the like.

We claim:

1. A sports racket consisting of a head and a handle, the head having a frame that borders the head, an unstressed monolithic lattice structure within the frame and extending from side to side of the frame and having a multiplicity of openings therein, and means in the centre of the head closing a plurality of openings only in the centre of the head without prejudicing the playing characteristics of the surface of the lattice structure.

2. A sports racket as claimed in claim 1 in which the means is integral with the lattice structure.

3. A sports racket as claimed in claim 2, said means being in the form of webs of a thickness less than the thickness of the remainder of said lattice structure.

4. A sports racket as claimed in claim 1, which is moulded integrally of plastics, said lattice structure consisting of a first plurality of spaced filaments that extend across the frame in one direction, said first filaments intersecting a further plurality of spaced filaments that extend across the frame in another direction, said first filaments being integral with said further filaments and forming with said further filaments said multiplicity of openings, said means closing a plurality of of said openings in the centre of the head and consisting of portions integral with the lattice.

5. A sports racket as claimed in claim 4 in which said integral portions of plastic closing said central openings are in the form of webs of a thickness less than the thickness of the filaments.

* * * * *